United States Patent [19]

Bennett et al.

[11] Patent Number: 4,582,238

[45] Date of Patent: Apr. 15, 1986

[54] RIVET DETAINING MEANS FOR RIVETING MACHINES

[75] Inventors: Alan Bennett, Cossington; Paul E. Morris, Gerrards Cross; Ronald Ormston; Ronald Evans, both of Aylesbury, all of England

[73] Assignee: The Bifurcated and Tubular Rivet Company Limited, Aylesbury, England

[21] Appl. No.: 624,140

[22] Filed: Jun. 25, 1984

[30] Foreign Application Priority Data

Jun. 27, 1983 [GB] United Kingdom ..... 8317389

[51] Int. Cl.[4] ..... B21J 15/32

[52] U.S. Cl. ..... 227/112; 227/51; 227/149

[58] Field of Search ..... 227/51, 52, 112, 149

[56] References Cited

U.S. PATENT DOCUMENTS 3,586,230 6/1971 Hill et al. ..... 227/51

3,647,129 3/1972 Ehrlich ..... 227/112

4,180,195 12/1979 Caley et al. ..... 227/149 X 4,436,238 3/1984 Seki ..... 227/149

*Primary Examiner*—Paul A. Bell

*Attorney, Agent, or Firm*—Scrivener Clarke Scrivener and Johnson

[57] ABSTRACT

A riveting apparatus comprises a portable riveting assembly which may be hand held or mounted on a robot arm. The assembly comprises a C-frame having an anvil mounted on one arm and a hydraulic ram mounted on the other arm. Rivets are supplied to a head assembly located between the anvil and piston rod via a flexible tube having a T-shaped cross-section. After a rivet has been supplied it is held positively in position ready for setting within pocket members by air pressure supplied along tube. Thus, the assembly can be moved rapidly and used in various orientations without displacing the rivet. Connections between the assembly and rivet supply and hydraulic power source are by way of flexible connections.

7 Claims, 4 Drawing Figures

Figures 1, 2, 3:
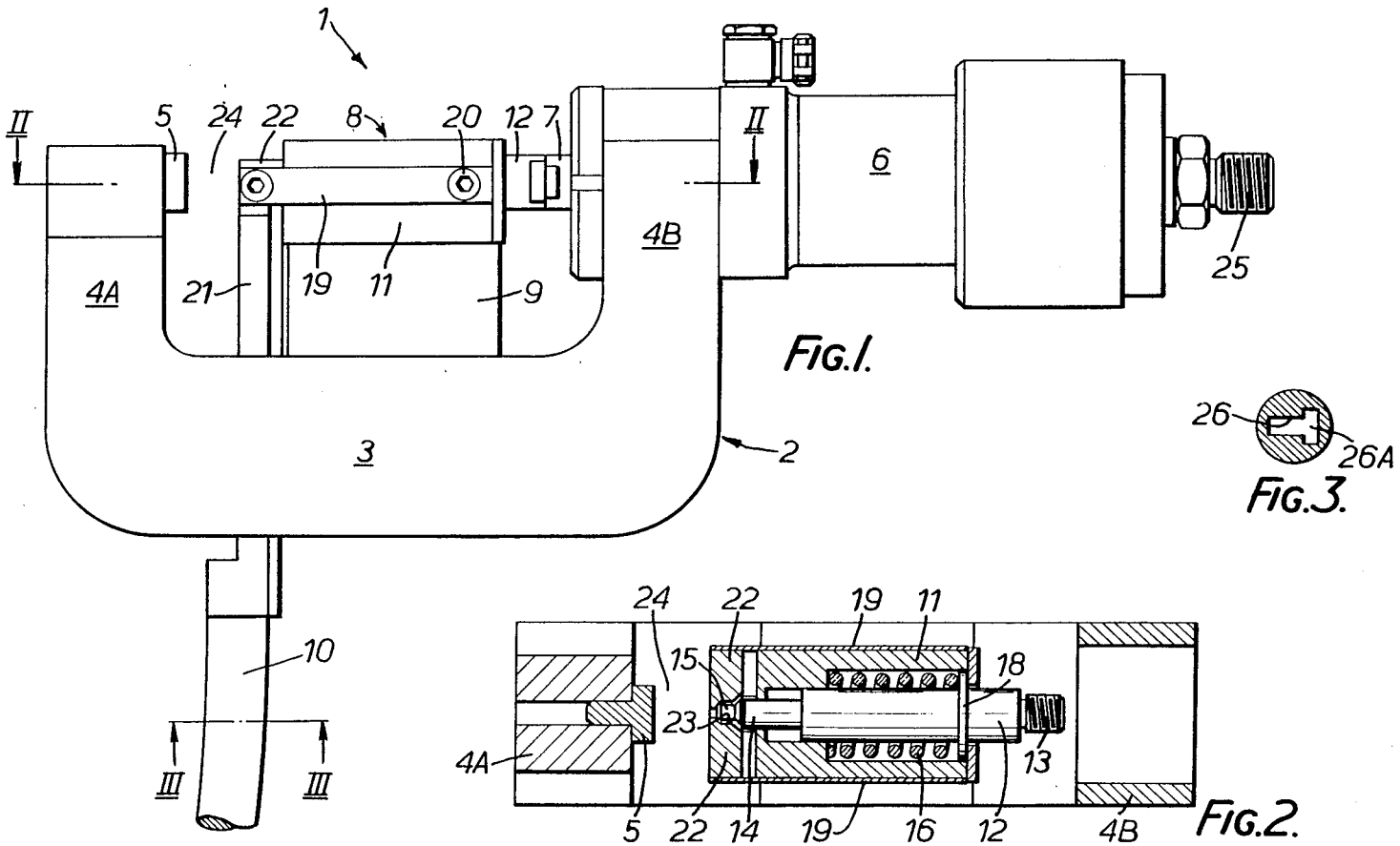

1
2
3
4A
4B
5
6
7
8
9
10
11
12
13
14
15
16
18
19
20
21
22
23
24
25
26
26A
II
III

RIVET DETAINING MEANS FOR RIVETING MACHINES

This invention relates to riveting machines, and more particularly to a self-piercing riveting machine, i.e. a machine in which it is not necessary to pre-form aligned holes to receive the rivet.

Self-piercing riveting machines have been known for a number of years, and offer the substantial advantage that the items to be riveted need not be provided with pre-formed holes to receive a rivet. Such machines often utilize special hardened steel rivets which require a substantial force in order to drive the rivet in order to pierce the items to be riveted, and to set the rivet. For this reason, self-piercing riveting machines have tended to be large fixed installations, and this limits the use of such machines to applications where the items to be riveted can readily be presented to a fixed machine.

Known self-piercing riveting machines suffer from the additional disadvantage that the rivet feed mechanism used will only operate when the machine is positioned to drive the rivet in a vertically downward direction. This in turn limits the machines to applications where the items to be riveted are located essentially in a horizontal plane. This precludes the use of such machines in many production techniques.

According to the present invention there is provided a self-piercing riveting machine comprising: a riveting assembly including an anvil, a hydraulically powered rivet driver, and a rivet detainer, the riveting assembly being positionable in use to locate items to be riveted between the anvil and the rivet detainer and being operable to advance the rivet driver toward the anvil to drive a rivet from the rivet detainer to pierce at least one of the items and to be set by the anvil; a rivet supply mechanism for supplying rivets to the rivet detainer, the rivet supply mechanism including a bulk container for holding a bulk supply of rivets, delivery means for delivering rivets from the bulk container in a preferred orientation to a passage extending to the rivet detainer, and means for propelling the rivets along the passage to the rivet detainer; and rivet holding means for positively holding each rivet in engagement with the rivet detainer until it is driven therefrom by the rivet driver.

In the preferred embodiment of the invention the riveting assembly forms a portable sub-unit which is connected to the rivet supply mechanism and hydraulic power source by flexible connectors, including a flexible tube which defines part of the rivet supply passage. In this manner the riveting assembly can be hand held to permit an operator to locate the assembly in a difficult position on, perhaps a large fabrication or can be mounted on the arm of a robot machine to operate in a manner similar to a robot operated spot-welding machine.

The rivet holding means preferably comprises compressed air supply means for supplying compressed air to the riveting assembly in such a manner that the rivet is held against the rivet detainer by air pressure. This arrangement can be effected in a particularly convenient manner if the rivets are propelled along the passage by compressed air, and the rivet passage forms a supply tube for supplying compressed air to hold the rivets against the rivet detainer. The rivet passage can, for example, be connected to a source of compressed air at all times when the riveting machine is in use. After each rivet is set a fresh rivet is injected into the passage and is propelled by the compressed air to the rivet detainer where it is held by compressed air until required to be set.

The constant supply of compressed air maintaining each rivet against the rivet detainer until the rivet is driven forward by the rivet driver ensures that the riveting assembly can be used in any orientation, and this offers substantial advantage in utilization of the machine both on large fabrications and in robot controlled assembly operations.

Figure 4:
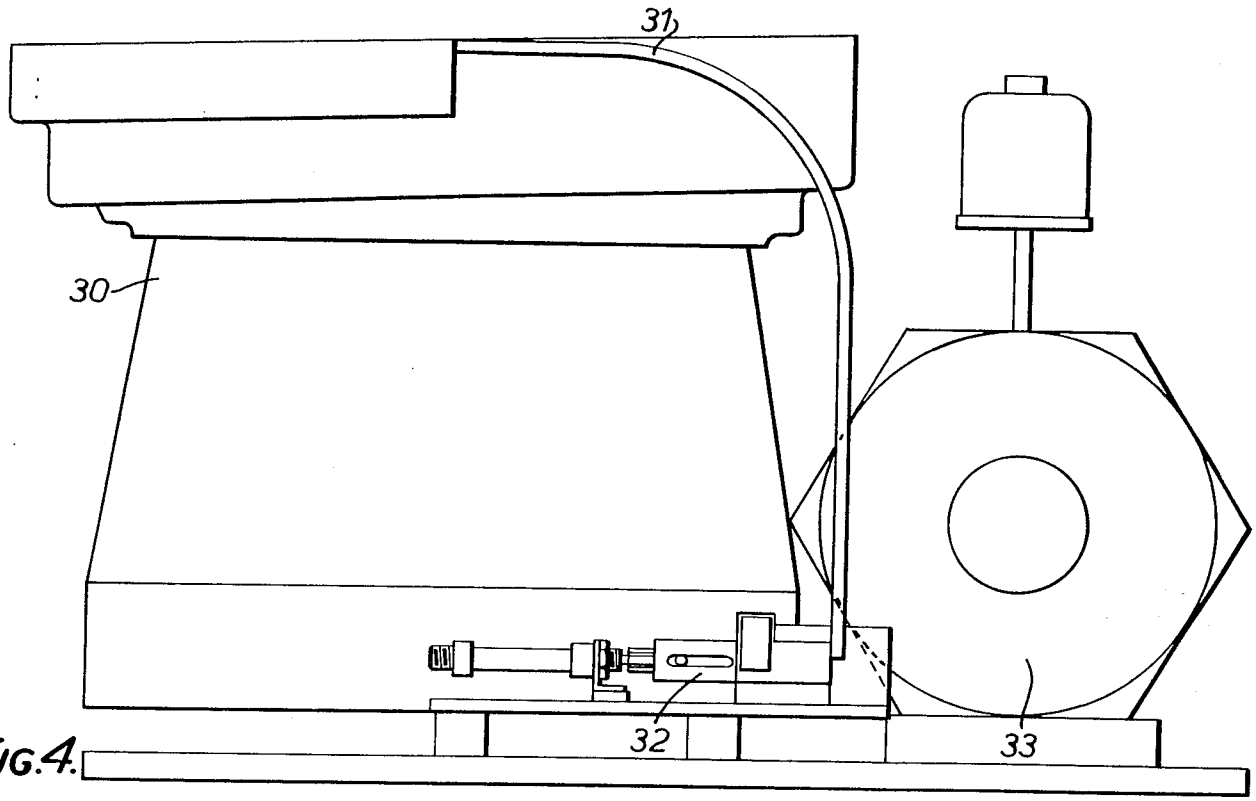

In a particularly preferred embodiment of the invention the rivet passage is generally T-shaped in transverse cross-section, and rivets are propelled along it with the head of the rivet held within the head of the T, i.e. the longitudinal axis of rivet is perpendicular to the longitudinal axis of the passage. In this way, the rivet can be brought to the correct position for setting in a particularly simple manner. The above and further features and advantages of the invention will become clear from the following description of a preferred embodiment thereof, given by way of example only, reference being had to the accompanying drawings wherein:

FIG. 1 is a side view and of a portable riveting assembly;

FIGS. 2 and 3 are respectively sections on the lines II—II and III—III of FIG. 1; and FIG. 4 is a side view of a rivet supply mechanism and power unit. Referring firstly to FIGS. 1 to 3 the portable riveting assembly 1 comprises a C-shaped frame 2 having a central portion 3 and arms 4A and 4B. A rivet setting anvil 5 is mounted on the frame 2 adjacent the extremity of one arm 4A, and a hydraulic ram 6 is mounted on the frame adjacent the extremity of the other arm 4B. The ram 6 has a piston rod 7 co-axially aligned with the anvil 5 for movement theretowards.

A head assembly 8 is slidably mounted on a block 9 which is in turn fixed to the central portion 3 of the frame 2. The head assembly 8 receives rivets along a supply passage via a flexible tube 10 as described in greater detail hereinafter, and upon movement of the piston rod 7 towards the anvil 5 advances into contact with the surface to receive the rivet, and thereafter guides the rivet as it is set by the riveting assembly.

The head assembly 8 includes a body 11 which is slidably mounted on the block 9, e.g. by way of a T-shaped head which engages in a complementary slot in the block. A plunger 12 is slidably mounted within the body and is normally connected to the piston rod 7 by way of a screw-threaded connection 13. The end 14 of the plunger includes an end face suitable for the rivet 15 to be set, e.g. if the rivet 15 has a flat head the end face of the plunger at the end 14 will be flat and will have an area substantially equal to that of the rivet head.

A compression spring 16 is pre-stressed between a shoulder 17 on the body 11 and a circlip 18 secured to the plunger. The spring 16 maintains the body 11 and plunger 12 in the relative positions shown in the drawing except during rivet setting, as described below.

A leaf spring 19 is secured to each side of the body 11 by way of respective screws 20 (omitted from FIG. 2 in the interests of clarity). The free end of each leaf spring carries a pocket member 22. In their relaxed condition, the springs 19 hold the pocket members as illustrated in FIG. 2 so that a rivet receiving pocket 23 is formed by the pocket members 22 and plunger end 14. In use, rivets are supplied to the pocket along a feed guide 21 and are maintained in position within the pocket by means of compressed air supplied to the guide 21 via the flexible tube 10. The shape of the pocket 23 is such that a constant supply of compressed air from the tube 10 will hold a rivet 15 in the position illustrated until actuation of the rivet seeting sequence.

In order to rivet two members together, the riveting assembly 1 is positioned by hand or by computer control via a robot arm to position the items to be riveted in the throat 24 which is defined between the pocket members 22 and the anvil 5. At this time a rivet 15 will be in the position illustrated in FIG. 2, and will be held in this position by compressed air as described above. To set the rivet hydraulic fluid under pressure is supplied to the ram 6 by way of an inlet fitting 25, causing the piston and piston rod 7 to move towards the anvil 5. As the piston rod 7 advances it carries with it the plunger 12, which in turn moves forward the body 11 and associated fittings through the action of spring 16. Movement continues until the times to be riveted are held between the anvil 5 and pocket members 22.

When the force supplied by the rams 6 is sufficient to overcome the pre-load of spring 16 and the effect of springs 19 and friction between the pocket members 22 and the item to be riveted, the plunger 12 will begin to move relative to the body 11 and will drive the rivet forward. The springs 19 yield to allow the pocket members 22 to move apart to accomodate forward movement of the rivet. The plunger 12 will then continue to move forward driving the rivet into the items to be riveted and setting the rivet in conventional manner. Forward movment of the plunger continues until the pressure within the hydrulic ram 6 reaches a predetermined set pressure, whereupon hydraulic pressure is released from the ram 6 and air return pressure is applied to the piston rod side of the piston in order to retract the piston rod and with it the head assembly.

The riveting assembly is then ready to receive a new rivet which is fed along the flexible tube 10 to the guide 21 to be held in the pocket 23 awaiting the next setting cycle.

It will be appreciated that the riveting assembly illustrated in the drawings is relatively small and can readily be manoeuvred by hand or on a robot arm. This renders the apparatus particularly suitable for use on large fabrication. It will also be noted that once a rivet 15 has been delivered to the pocket 23 it is positively held in position ready for setting by a compressed air flow, and accordingly the riveting assembly can be held at any angle to effect setting, and can be moved rapidly and in complex movement paths without displacing the rivet from the pocket 23.

To ensure that the rivet arrives at the guide 21 at the correct orientation to be received in the pocket 23 the flexible tube preferably has a T-shaped bore 26 as shown in FIG. 3. Provided that the bore is suitably proportioned, a rivet inserted into the bore with its head in the cross-bar 26A of the T will move along the tube in that orientation, and will accordingly be correctly presented to the guide 21 for movement to the pocket 23.

Any suitable means may be provided to supply rivets to the flexible tube 10, hydraulic power to the inlet 25 and overall system control. FIG. 4 shows schematically one suitable arrangement for providing for rivet feed and hydraulic power.

In the arrangement shown in FIG. 4, a vibratory bowl feed device 30 of conventional design feeds rivets into a chute 31 for supply to an injector device 32 which, when triggered, inserts a single rivet into the flexible tube 10 for passage to the riveting assembly. Hydraulic power is provided by way of an air powered hydraulic intensifier 33. System control may be by way of pneumatic logic elements or electrical control or electronic logic control. In a typical embodiment using pneumatic logic control an entire riveting sequence may be put in hand merely by tripping the logic control whereupon air is applied to the intensifier 13 until the predetermined set pressure is reached, whereupon air pressure is released from the intensifier and a new rivet is injected into the flexible tube 10 by the injector 32.

The embodiment of the invention described above is particularly simple in that relatively few connections need extend between the riveting assembly and the rivet and power supply assembly, and such connections can all be relatively flexible. It will be appreciated, however, that other considerably more complex control arrangements can used as circumstances require without departing from the fundamental nature of the invention as defined by the appended claims.

It will further be appreciated that different shapes and forms of rivet may be used in the machine by suitable choice of pocket members 22, anvil shape 5, and setting pressure.

We claim:

1. A self-piercing riveting machine comprising: a riveting assembcy including an anvil, a hydraulically powered rivet driver, and a rivet detainer for holding a rivet immediately prior to setting thereof, the riveting assembly being positionable in use to locate items to be riveted between the anvil and the rivet detainer and being operable to advance the rivet driver towards the anvil to drive a rivet from the rivet detainer to pierce at least one of the items and to be set by the anvil; a rivet supply mechanism for supplying rivets to the rivet detainer, the rivet supply mechanism including a bulk container for holding a bulk supply of rivets, delivery means for delivering rivets from the bulk container in a preferred orientation to a passage extending to the rivet detainer, and means for propelling the rivets along the passage to the rivet detainer; and rivet holding means for positively holding each rivet in engagement with the rivet detainer until it is driven therefrom by the rivet driver, said rivet holding means comprising compressed air supply means for supplying compressed air to the riveting assembly to hold the rivet against the rivet detainer by air pressure.

2. A self-piercing riveting machine according to claim 1 wherein the riveting assembly is movable as a sub-unit relative to the rivet supply mechanism and hydraulic power source, and is connected to the rivet supply mechanism and hydraulic power source by flexible connectors.

3. A self-piercing riveting machine according to claim 2 wherein the rivets are propelled along the passage by compressed air and air is continuously supplied to the riveting assembly via the passage to hold a rivet within the riveting assembly in engagement with the rivet detainer.

4. A self-piercing riveting machine according to claim 1 wherein the rivet supply passage is generally T-shaped and rivets are supplied along the passage with the head of the rivet located in the head of the passage.

5. A self-piercing riveting machine according to claim 1 wherein the rivet detainer comprises a pair of spring biased pocket members which in part define a pocket at the end of the rivet supply passage and which move apart to permit the rivet to be ejected from the pocket during setting.

6. A self-piercing riveting machine according to claim 5 wherein the pocket members and the terminal portion of the passage are part of a head assembly which, prior to rivet setting, is moved by the rivet driver into engagement with the items to be riveted to hold the items between the anvil and the head assembly during setting.

7. A self-piercing riveting machine according to claim 5 wherein the axis of the passage is perpendicular to the axis of the pocket, and the pocket is generally complementary to the shape of the rivet, when viewed in a plane containing the axis of the rivet and perpendicular to the axis of the passage.

* * * * *